US005599392A

United States Patent [19]

Liang et al.

[11] Patent Number: 5,599,392

[45] Date of Patent: Feb. 4, 1997

[54] ROD HOLDER WITH SEPARATE POSITIONABLE CONTACT ELEMENTS FOR ROD METERING

[75] Inventors: Shihua Liang, Roscoe; Andrew W. Osburn, South Beloit, both of Ill.; Gerald R. Garde, Beloit, Wis.

[73] Assignee: Beloit Technologies, Inc., Wilmington, Del.

[21] Appl. No.: 506,408

[22] Filed: Jul. 24, 1995

[51] Int. Cl.[6] ..... B05C 17/00

[52] U.S. Cl. ..... 118/110; 118/117; 118/119; 118/122; 118/126; 118/261; 118/410; 118/413; 118/414; 118/419

[58] Field of Search ..... 118/110, 117, 118/118, 119, 122, 123, 126, 261, 410, 413, 414, 419; 162/281; 427/356, 359; 15/256.5, 256.52; 101/157, 169, 365

[56] References Cited

U.S. PATENT DOCUMENTS

| | | | |
|---|---|---|---|
| 4,245,582 | 1/1981 | Alheid et al. | 118/119 |
| 4,889,073 | 12/1989 | Meinander | 118/119 |
| 5,383,968 | 1/1995 | Rantanen et al. | 118/119 |

FOREIGN PATENT DOCUMENTS

| | | |
|---|---|---|
| 0571849 | 1/1995 | European Pat. Off. . |
| WO-A-9117838 | 11/1991 | WIPO . |
| WO-A-9218696 | 10/1992 | WIPO . |
| WO-A-9504858 | 2/1995 | WIPO . |
| WO-A-9516074 | 6/1995 | WIPO . |

*Primary Examiner*—Laura Edwards
*Attorney, Agent, or Firm*—Dirk J. Veneman; Raymond W. Campbell; Gerald A. Mathews

[57] ABSTRACT

A rigid metal housing is positioned downstream of a coating applicator. The housing supports a plurality of positionable contact elements formed of a low friction, high wear-resistant material, which extend inwardly from the housing to engage a slow speed rotating rod. At least one of the contact elements is adjustable to support the rod for stable rotation, and to retain an effective seal between the contact elements and the rod to thereby prevent leakage of clearing/lubricating fluid into the applied coating. The contact elements may be advanced inwardly as the elements and the rod wear, thereby extending the effective life of the rod holder apparatus. Screws may bear against a rear contact element through segmented backing plates allowing refinement of the coat weight along the width of the substrate. Furthermore, an air tube may be positioned between the housing and a rear fixture to adjust overall coating thickness.

24 Claims, 3 Drawing Sheets

ROD HOLDER WITH SEPARATE POSITIONABLE CONTACT ELEMENTS FOR ROD METERING

FIELD OF THE INVENTION

The present invention relates to apparatus for applying coatings to moving substrates such as paper, applicator rolls, felts, and blankets, in general, and to rod metering apparatus in particular.

BACKGROUND OF THE INVENTION

Paper of specialized performance characteristics may be created by applying a thin layer of coating material to one or both sides of the paper. The coating is typically a mixture of a fine plate-like mineral, typically clay or particulate calcium carbonate; coloring agents, typically titanium dioxide for a white sheet; and a binder which may be of the organic type or of a synthetic composition. In addition, rosin, gelatins, glues, starches or waxes may be applied to paper for sizing.

Coated paper is typically used in magazines, commercial catalogs and advertising inserts in newspapers and other applications requiring specialized paper qualities.

Various devices have been employed in the past to apply coatings to paper, either directly, or by first applying to a roll, as in a size press. Once coating has been applied to the substrate, it is necessary to meter the coating to a desired thickness and uniform level. Uneven coating thickness will produce blemishes and quality variances in the finished paper, and is highly undesirable.

One approach to metering the coating is to position a flexible blade against the backing roll downstream of the coating pond. Blades, however, directly engage the coating, and in some applications, blade defects may be telegraphed to the coating, causing corresponding defects in the paper. Often a fiber will be caught on the blade and cause a nonuniform coating or stripe.

Rod metering devices have a rod which extends in the cross-machine direction the length of the substrate. One conventional rod holder utilizes a press fit between a rod holder housing and the rod. This press fit of the rod to the holder ensures an effective seal between the housing and the rod to prevent leakage of the cleaning and lubricating fluid which must be introduced to the rod. However, a tight fit places heavy demands on the motor which rotates the rod, and the friction between the rod and the housing causes rapid wear on the rod metering device, and hence necessitates frequent replacement. Down time of a coating apparatus to serve the rod metering applicator is costly, because production of paper must stop, and should be minimized.

What is needed is a rod holder which is long lasting, rapidly serviceable, and which at the same time holds the rod firmly, maintains an effective seal between the rod and the holder, and allows easy rotation of the rod.

SUMMARY OF THE INVENTION

The rod holder for rod metering of this invention has a rigid metal housing with a plurality of positionable contact elements formed of a low friction and high wear-resistant material which extend inwardly from the housing to engage a slow speed rotating rod. At least one of the contact elements is adjustable to retain an effective seal between the contact elements and the rod to thereby prevent leakage of clearing/lubricating fluid into the applied coating. The contact elements may be advanced inwardly as the contact elements wear, thereby extending the effective life of the rod holder apparatus. A plurality of screws may bear against a rear contact element through segmented backing plates to permit refinement of the coat weight along the width of the substrate. In one embodiment, an air tube may be positioned between the housing and a rear fixture to adjust overall coating thickness.

It is a feature of the present invention to provide a rod holder of extended wear life.

It is another feature of the present invention to provide a rod holder in which the sealing pressure between the rod and the housing is adjustable.

It is a further feature of the present invention to provide a rod holder with low friction support of the rotating rod and an effective seal between the rod holder and rod.

It is an additional feature of the present invention to provide a rod holder which permits adjustment of the coating depth along the width of the coated substrate.

It is also a feature of the present invention to provide a rod holder which may be serviced without removal from the papermaking machine.

It is yet another feature of the present invention to provide a rod holder with replaceable wear surfaces.

Further objects, features and advantages of the invention will be apparent from the following detailed description when taken in conjunction with the accompanying drawings.

DESCRIPTION OF THE PREFERRED EMBODIMENT

Figure 1:
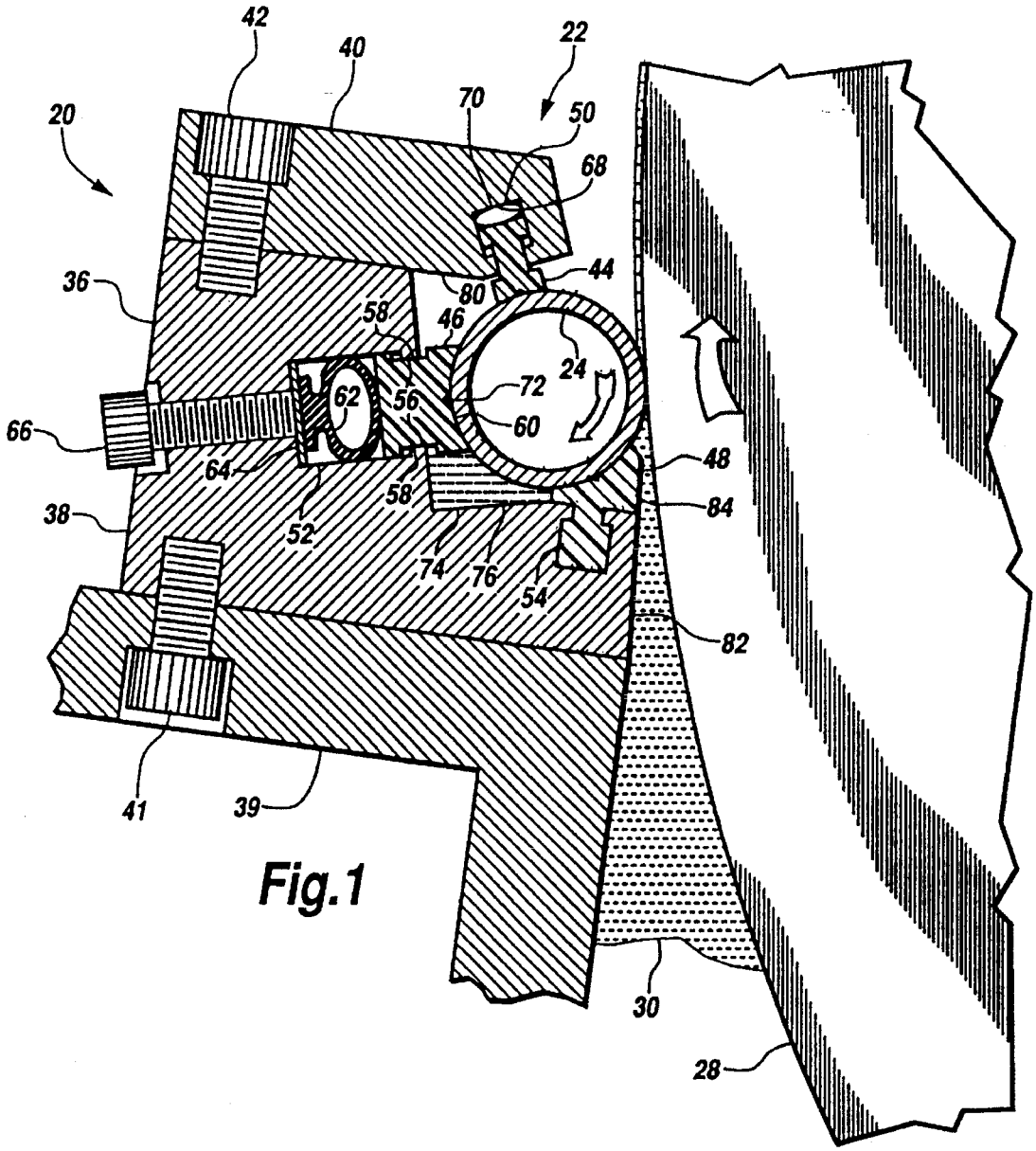
FIG. 1 is a cross-sectional view of the rod holder of this invention holding a rod for metering of a coating in a size press application.
Figure 2:
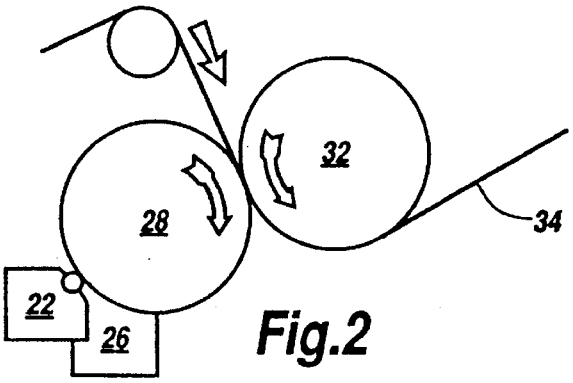
FIG. 2 is a schematic view of the rod holder of FIG. 1 in relation to the coater and the backing roll of a size press.
Figure 3:
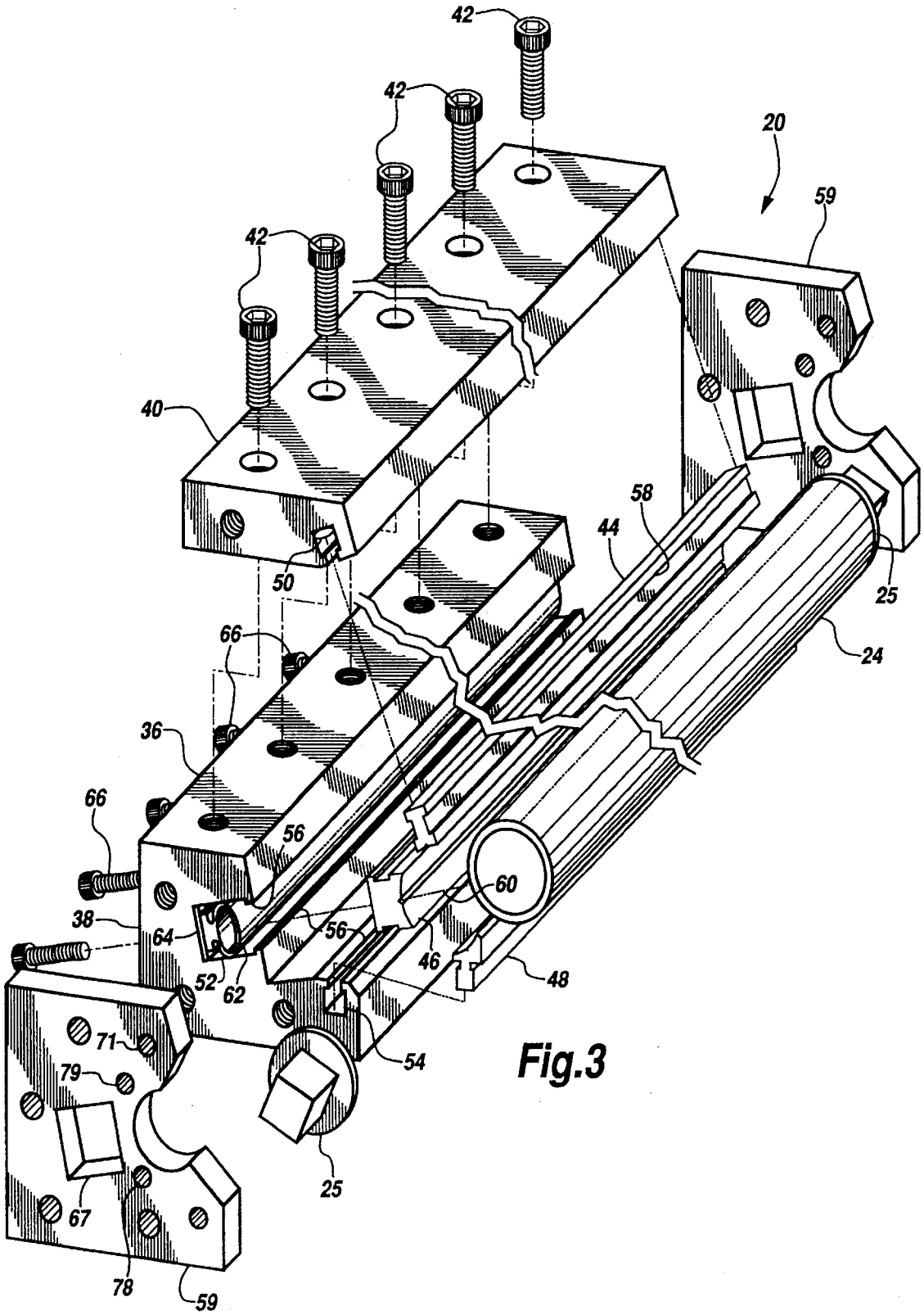
FIG. 3 is an exploded isometric view of the rod holder and rod of FIG. 1.

Referring more particularly to FIGS. 1–4, wherein like numbers refer to similar parts, a rod holder 20 is shown in FIGS. 1–3. The rod holder 20 is part of a rod metering assembly 22 which includes a cylindrical metering rod 24. As shown in FIG. 2, the rod metering assembly 22 is used in conjunction with a coating apparatus 26 which is positioned with respect to a roll 28. The coating apparatus 26 may be a short dwell coater or other know coater. In the size press application illustrated, the coating apparatus 26 applies coating 30 to the roll 28, which is then metered by the rod metering assembly 22 to a desired thickness and consistency. The metered coating travels along the roll 28 to a nip defined between the roll 28 and a backing roll 32. A web of paper 34 travels through the nip and is thereby coated. It should be noted that the rod metering assembly 22 of this invention may also be employed with coating apparatus which applies the coating directly to the paper web supported against a backing roll.

The rod 24 is preferably formed of ceramic coated stainless steel, for example, using a tungsten carbide coating, and the diameter of the rod may be from about one half inch, to about two inches, for example, approximately 1.375 inches in diameter. The rod may alternatively have a chrome plating or other appropriate surface finish. As shown in FIG. 3, the rod 24 is a cylindrical tube which a wall thickness of from about one-eighth inch to about one-quarter inch. In applications having smaller diameter rods, the rod may be solid. End plates 25 are welded to the rod 24 and are rotatably engaged in bearings and driven by a motor, not shown. The rod 24 extends in the cross-machine direction, and will be at least as wide as the web being coated, which may be three hundred inches or more.

The rod 24, as shown in FIG. 3, is received within the rod holder 20 and is driven by a motor, not shown, to rotate so that the rod surface moves in a direction opposite to the direction of the roll 28 surface when the rod 24 engages the roll 28. The rod holder 20 has a housing 36 composed of a base 38 and a top plate 40 connected by cap screws 42 to the base. The housing base 38 and top plate are preferably formed of a rigid material such as stainless steel or aluminum. The base 38 is rigidly connected to a mounting fixture 39 by a plurality of fasteners 41.

Three contact elements 44, 46, 48 are received in slots 50, 52, 54 formed in the housing 36. As best shown in FIG. 1, each slot has two lips 56, each of which engages within a groove 58 on the side of a contact element. The top and rear contact elements have grooves 58 which are larger than the lips 56, and thus may move toward and away from the rod within the slots. The contact elements 44, 46, 48 are preferably formed of a high wear-resistant, low friction material, such as the fluoroplastic resin known as TEFLON®, and manufactured by E. I. Du Pont de Nemours and Company of Wilmington, Del.

The housing 36, as shown in cross-section in FIG. 1, extends uniformly the width of the roll 28. As shown in FIG. 3, an end dam 59 is connected by fasteners to each end of the housing.

Each contact element 44, 46, 48 has an engagement face 60 which is concave and has a radius of curvature which is approximately the same as the radius of the rod 24, when new. The top contact element 44 is received within a top slot 50 formed in the top plate 40. The slot 50 extends the length of the housing in the cross-machine direction, and the depth of the slot 50 is angled so that the top contact element 44 can travel radially in the slot toward the rod 24.

The rear contact element 46 is received within a rear slot 52, which extends the length of the housing in a cross-machine direction, and which extends generally radially so that the rear contact element 46 can travel radially toward the rod. The front contact element 48 in a preferred embodiment is fixed within the front slot 54.

An inflatable air tube 62 is positioned in the rear slot 52 between the rear contact element 46 and a plurality of segmented backing plates 64. The air tube 62 is formed of a resilient material, such as rubber or an elastic plastic material, and is inflatable to move the rear contact element 46 toward the rod 24. Each air tube is inflatable by an air supply source, not shown, which provides a means for inflating the tube. As shown in FIG. 1, a plurality of adjustment screws 66 extend through the housing base 38 and engage against the backing plates 64. The rear air tube 62 is inflatable to maintain constant contact between the rear contact element 46 and the rod 24, even as the contact element is worn away with contact with the rod. To a lesser extent, the diameter of the rod may also be reduced with extended wear. Uniformity in coating thickness across the width of the rod is highly desirable. Variations in thickness of the applied coating may be dealt with by adjustment of the screws 66 to adjust the displacement of the rear contact element 46 and hence the rod 24 itself. The rear air tube 62 passes through an opening 67 in the end dam 59 and is connected to a source of pressurized air, not shown.

To achieve an improved seal between the holder and the rod, to stabilize the rod, and to further accommodate variations in the diameter of the rod 24, a top air tube 68 is positioned between the top contact element 44 and the backing surface 70 of the top slot 50. The top air tube 68 in a preferred embodiment is smaller than the rear air tube. Pressurized air from an external supply may be introduced into the top air tube 68 through an opening 71 in the end dam 59. The air tubes serve as a means for applying pressure to the contact elements to retain a seal between the contact elements and the rod.

Each contact element 44, 46, 48 has a central v-shaped groove 72 which bisects the concave contact element engagement face 60 and extends generally parallel to the axis of the rod 24 and ensures that the contact element will make at least line contact with the rod in two locations.

As shown in FIG. 1, a fluid cavity 74 is defined between the front contact element 48, the rear contact element 46, and the rod 24. A cleaning fluid 76, preferably water, is introduced into the fluid cavity 74 through an opening 78 in an end dam 59. The cleaning fluid 76 flows through the housing and out an opening in the opposite end dam. The cleaning fluid 76 serves two primary purposes. First, the fluid removes coating, fibers, or web elements which become adhered to the rod 24 and which find their way past the front contact element 48. Secondly, the fluid lubricates between the contact elements and the rod 24. For coating consistency it is desirable to keep the cleaning fluid from making contact with and mingling with the coating 30 which is being applied. The contact elements form a seal with the rod, and are adjusted as needed by the air tubes 62, 68 to maintain a liquid seal to minimize escape of cleaning fluid.

Another cavity 80 is defined between the rear contact element 46, the top contact element 44, and the rod 24. The cavity 80 may serve as a drain channel for cleaning fluid which progresses past the rear contact element 46. Alternatively, if increased cleaning action is needed, cleaning fluid may also be introduced and circulated through the cavity 80 through an opening 79 in the end dam 59.

The rod holder 20 would be expected to experience a long life between replacements of rods compared to rod holders which employ a press fit between the rod and the housing. Because the Teflon® plastic contact elements are of low friction, the rotating rod 24 may be subjected to much reduced levels of friction. As a consequence, the torque-required to rotate the rod 24 is also reduced. Nonetheless, with operation of the rod holder 20 in a coating application, the contact elements will experience wear from contact with the coating and the rod 24.

Regular adjustment of the air tubes bearing against the top and rear contact elements will permit an appropriate seal to be maintained and consistent coatings to be applied even with wear of the contact elements. Should the contact elements become excessively worn, they may be replaced without the need to remove the entire rod holder 20 from its fixture on the papermaking machine. By removal of a single end dam 59, the contact element slots will be exposed, and the contact elements may be extracted through the slot openings. The polymer from which the contact elements is formed is somewhat flexible, and hence it is possible to bend the contact elements as they are extracted, allowing for extraction in a limited space in the cross-machine direction.

Because the contact elements are distinct from the housing, the housing may be formed of a material which is sufficiently rigid to support the loads of the rod, while the contact elements maybe formed of a low friction and high wear-resistant material. Furthermore, independent loading of each contact element by an air pressure tube, or by any other appropriate loading means, permits highly effective sealing. In addition, the individual parts of the holder may be replaced as they wear, possibly at different rates, thereby ensuring maximum utilization of each part.

The rod holder 20 effectively performs the three important functions in rod metering: firmly holding the rod, providing reasonable seal pressure to prevent the cleaning fluid from getting into the coating, and allowing easy rotation of the rod.

The housing 36 base 38 has a front face 82 which is inclined with respect to an imaginary plane which is tangent to the rod 24 at the nip between the rod 24 and the roll 28. The inclination of the front face 82 is between about 5° and 35° with respect to said imaginary plane, depending on the machine speed, web grade, and coating formulation which are intended to be used with a particular rod holder. A preferred inclination within this range is between 8° and 15°.

The front contact element 48 has a front face 84 which is approximately coplanar with the front face 82 of the base 38, and which defines a continuous surface with the base front face. The narrow angle of these surfaces serves to position vortex formation farther upstream from the line of coating application, and hence contributes to more even application of coating.

Figure 4:
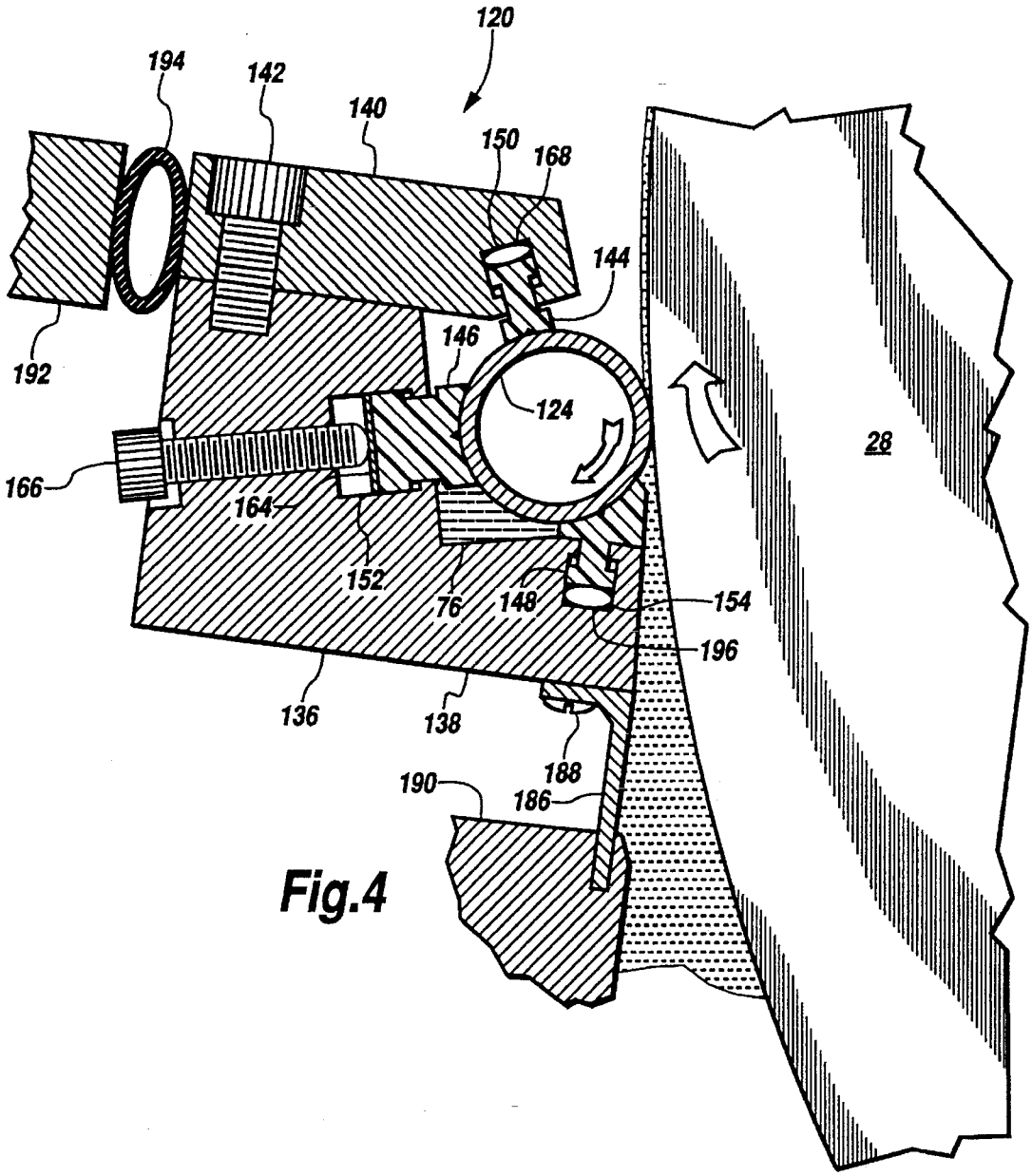
FIG. 4 is a cross-sectional view of an alternative embodiment rod holder of this invention having an air tube exterior to the housing.

An alternative embodiment rod holder 120, shown in FIG. 4, has an air tube 194 which is positioned between the housing 136 and a rear mounting fixture 192 which is spaced from the roll 28. This air tube 194 provides a means for deflecting the housing to control the thickness of the coating applied to the substrate. The housing 136 has a top plate 140 which is connected by cap screws 142 to a housing base 138. The base 138 is connected by screws 188 to a blade 186 which is clamped to a lower fixture 190. The blade 186 is somewhat flexible, and hence allows the housing 136 to pivot toward the roll 28 when the air tube 194 is inflated. The air tube 194 preferably engages the upper portions of the housing 136 adjacent the top plate 40 to apply greater leverage. By adjusting the inflation of the air tube 194, the applied film thickness may be controlled.

The rod 124 may be mounted in a manner similar to the mounting of the rod 24 in the rod holder 20, however, as an alternative to that type of mounting, the rod 124 may be supported by two contact elements 144, 148 which are positionable by inflatable air tubes 168, 196, and a rear contact element 146 which is adjusted by a series of screws 166 bearing against segmented backing plates 164. The top contact element 144 is moveable generally radially in a top contact element slot 150, and the front contact element is moveable in a front slot 154. The rear contact element 146 is moveable generally radially in a rear slot 152. However, by eliminating the flexible air tube adjacent the rear contact element, movement of the rear contact element during coating application is eliminated, which may contribute to more stable flow in certain applications.

It should be noted that where air pressure tubes have been disclosed, alternative loading means may be employed, depending on design considerations, for example springs of various types may be used. Additionally, although air tubes behind two or three contact elements have been disclosed, a single air tube, for example behind the top contact element, may also be effective.

It is understood that the invention is not limited to the particular construction and arrangement of parts herein illustrated and described, but embraces such modified forms thereof as come within the scope of the following claims.

We claim:

1. A rod holder for metering of coatings for application to a moving substrate, the rod holder comprising:

a housing extending in a cross-machine direction, the housing having portions defining a cavity for receiving a cylindrical rod therein; a plurality of contact elements mounted to the housing, the contact elements extending inwardly from the housing for engaging a cylindrical rod within the housing; and a means for adjusting the position of the contact elements with respect to the housing to sealingly engage a rotating rod within the housing, whereby the means for adjusting allows a seal to be maintained between the contact elements and a rod supported within the housing with extended wear.

2. The rod holder of claim 1 wherein the contact elements extend within cross-machine direction slots defined by portions of the housing, and wherein the means for adjusting the position of the contact elements comprises at least one expandable air tube positioned in one of said slots between the housing and a contact element, such that inflation of the air tube drives a contact element to engage a rod supported in the housing.

3. The rod holder of claim 2 wherein at least one of the contact elements is fixedly connected to the housing.

4. The rod holder of claim 1, wherein the contact elements comprise:

a first contact element positioned above the rod;

a second contact element positioned behind the rod; and a third contact element positioned beneath the rod.

5. The rod holder of claim 4 wherein the means for adjusting the contact elements comprises:

a first inflatable air tube positioned between the housing and the first contact element; and means for inflating the air tube.

6. The rod holder of claim 5 wherein the means for adjusting the contact elements further comprises a second inflatable air tube positioned between the housing and the second contact element.

7. The rod holder of claim 1 wherein a rear contact element is positioned rearwardly of the rod, and further comprising:

a plurality of plate segments positioned rearward of the rear contact elements between the rear contact element and the housing; and a plurality of adjustment screws extending through the housing to engage the plate segments, such that the plate segments may be positioned closer to and further away from the substrate to thereby adjust the coating thickness applied.

8. The rod holder of claim 1 wherein the housing comprises:

a base having portions defining a front slot and a rear slot; and a top plate having portions defining a top slot, wherein the top plate is removably fastened to the base, and wherein a contact element is engaged within each of the front slot, the rear slot, and the top slot.

9. The rod holder of claim 1 wherein the housing has a front surface which faces the substrate, and wherein the substrate defines a nip with a rod supported by the rod holder, and wherein the front surface is inclined between about 5° and 35° with respect to an imaginary plane which is tangent to the rod at the nip.

10. The rod holder of claim 9 wherein a front contact element is engaged with the housing which extends between the substrate and the rod, and wherein the front contact element has a front surface which is substantially coplanar with the housing front surface.

11. The rod holder of claim 1 wherein the housing is pivotably mounted with respect to the substrate, and further comprising a means for deflecting the housing toward and away from the substrate, to thereby adjust the thickness of the coating applied to the substrate.

12. The rod holder of claim 1 further comprising:

a first mounting fixture, positioned beneath the housing;

a blade which extends between the first mounting fixture and the housing, and which flexibly connects the housing to the first mounting fixture;

a second mounting fixture spaced from the blade; and an adjustable air tube extending between the second mounting fixture and the housing, whereby inflation of the adjustable air tube deflects the housing and a rod supported therein toward the substrate, to thereby adjust the applied coating thickness.

13. Apparatus for metering coating on a moving substrate, the apparatus comprising:

a housing extending in a cross-machine direction and formed of a first material;

a rotatable cylindrical rod positioned within the housing and extending in a cross-machine direction;

a plurality of removable contact elements mounted to the housing and extending generally radially to engage and support the rod, wherein the contact elements are formed of a second material; and means for adjusting the radial position of at least one of said contact elements to retain a seal between the contact elements and the rod with changing rod and contact element dimensions.

14. The apparatus of claim 13 wherein the first material is a metal, and the second material is a polymer.

15. The apparatus of claim 13 wherein the second material is a fluoroplastic resin.

16. The apparatus of claim 13 wherein each contact element has a concave engagement surface which engages the rod.

17. The apparatus of claim 16 wherein a groove extends in the cross-machine direction along each contact element to divide the engagement surface into to segments, such that each contact element makes at least line engagement with the rod in two locations.

18. Apparatus for metering coating on a moving substrate, the apparatus comprising:

a housing extending in a cross-machine direction, and having portions defining a plurality of slots which extend in the cross-machine direction;

a rotatable cylindrical rod positioned within the housing and extending in a cross-machine direction;

a plurality of contact elements, wherein each contact element is engaged with one of the housing slots, and wherein each contact element engages and supports the rod; and an inflatable air tube positioned in a housing slot between one of the contact elements and the housing, wherein inflation of the air tube causes said one contact element to advance radially toward the rod to engage the rod.

19. The apparatus of claim 18 wherein the housing is formed of a substantially rigid material, and the contact elements are formed of a low-friction and high wear-resistant material.

20. The apparatus of claim 18 wherein the contact element is formed of a fluoroplastic resin.

21. The apparatus of claim 18 wherein each contact element has a concave engagement surface which engages the rod.

22. The apparatus of claim 18 wherein a groove extends in the cross-machine direction along each contact element to divide the engagement surface into two segments, such that each contact element makes at least line engagement with the rod in two locations.

23. The rod holder of claim 18 wherein a front contact element is engaged with the housing which extends between the substrate and the rod, and wherein the front contact element has a front surface which is inclined with respect to an imaginary plane which is tangent to the rod at a nip defined between the rod and the substrate, and wherein the front surface is inclined between about 5° and 35° with respect to the imaginary plane.

24. The rod holder of claim 18 further comprising:

a first mounting fixture, positioned beneath the housing;

a blade which extends between the first mounting fixture and the housing, and which flexibly connects the housing to the first mounting fixture;

a second mounting fixture spaced from the blade; and an adjustable air tube extending between the second mounting fixture and the housing, whereby inflation of the adjustable air tube deflects the housing and a rod supported therein toward the substrate, to thereby adjust the applied coating thickness.

* * * * *